US005364232A

United States Patent [19]

Kimura et al.

[11] Patent Number: 5,364,232

[45] Date of Patent: Nov. 15, 1994

[54] VARIABLE DISPLACEMENT COMPRESSOR

[75] Inventors: Kazuya Kimura; Hiroaki Kayukawa; Kenji Takenaka; Yoshihiro Makino, all of Kariya, Japan

[73] Assignee: Kabushiki Kaisha Toyoda Jidoshokki Seisakusho, Kariya, Japan

[21] Appl. No.: 129,596

[22] Filed: Sep. 30, 1993

Related U.S. Application Data

[63] Continuation-in-part of Ser. No. 952,836, Mar. 3, 1992.

[30] Foreign Application Priority Data

Oct. 1, 1992 [JP] Japan ..... 4-263319

[51] Int. Cl.[5] ..... F04B 1/12

[52] U.S. Cl. ..... 417/222.1; 417/269; 74/60; 91/499

[58] Field of Search ..... 417/222.1, 222.2, 269, 417/270; 74/60; 91/499, 504, 505

[56] References Cited

U.S. PATENT DOCUMENTS

| | | | |
|---|---|---|---|
| 4,073,603 | 2/1978 | Abendschein et al. | 417/222 |
| 4,073,604 | 2/1978 | Chen | 417/226 |
| 4,178,135 | 12/1979 | Roberts | 417/222 |
| 4,221,545 | 9/1980 | Terauchi | 417/269 |
| 4,553,905 | 11/1985 | Swain et al. | 417/222 |
| 4,581,980 | 4/1986 | Berthold | 92/12.2 |
| 4,674,957 | 6/1987 | Chia et al. | 417/222 |
| 4,732,595 | 3/1988 | Ohta et al. | 417/222 |
| 4,815,358 | 3/1989 | Smith | 92/12.2 |
| 4,884,952 | 12/1989 | Kanamaru et al. | 417/222 |
| 5,055,004 | 10/1991 | Ebbing et al. | 417/222 R |
| 5,095,807 | 3/1992 | Wagenseil | 92/12.2 |
| 5,174,728 | 12/1992 | Kimura et al. | 417/222.2 |
| 5,181,453 | 1/1993 | Kayukawa et al. | 92/12.2 |
| 5,184,536 | 2/1993 | Arai | 91/505 |
| 5,228,841 | 7/1993 | Kimura | 417/222.2 |
| 5,292,233 | 3/1994 | Takenaka et al. | 417/222.2 |
| 5,304,042 | 4/1994 | Kayukawa | 417/222.1 |

FOREIGN PATENT DOCUMENTS 62-183082 11/1987 Japan .

*Primary Examiner*—Richard A. Bertsch
*Assistant Examiner*—Peter Korytnyk
*Attorney, Agent, or Firm*—Brooks Haidt Haffner & Delahunty

[57] ABSTRACT

A variable displacement compressor includes a hinge mechanism having a pair of support arms integrally formed with and protruding from the drive plate, and guide pins which connect the swash plate with the support arms. Each support arm is formed having a unshaped cutaway portion defining a channel for supporting ball portion of the hinge mechanism. The ball portion pivotably secured in the channel portion of the support arm, is attached to guide pin which in turn connects to a bracket protruding from the swash plate. The ball portion transmits pressure & rotational forces generated by the pistons and rotational force of the drive plate respectively. The forces cause the ball portion of the hinge mechanism to impinge upon pre selected surface area of the u-shaped support arm. By impinging on these preselected surface areas of the u-shaped support arm, the ball portion will not disengage from the channel portion of the support arm. Moreover the shape of the support arm increases the motility of the ball portion and associate guide pin secured within the support arm. The guide pin is slidably inserted into either the support arm or the swash plate, and is rotatably supported by means of the support arm.

12 Claims, 9 Drawing Sheets

VARIABLE DISPLACEMENT COMPRESSOR

BACKGROUND OF THE INVENTION

This is a continuation-in-part of co-pending U.S. application Ser. No. 07/952,836 filed on Mar. 3, 1992, now abandoned, which is incorporated herein by reference.

FIELD OF THE INVENTION

The present invention relates generally to variable displacement compressors. More particularly, the invention relates to an improved hinge mechanism for connecting a drive plate with a swash plate in the variable displacement compressor.

DESCRIPTION OF THE RELATED ART

Variable displacement compressors have a wide variety of applications including use as compressors for air conditioning, and refrigeration systems such as automotive air conditioners. Japanese Unexamined Utility Model Publication No. 62-183082 discloses a conventional variable displacement swash plate type compressor illustrated in FIG. 9. This compressor includes a housing 100 having a cylinder block 103, a crank chamber 101 formed therein for accommodating an inclination changeable wobble plate assembly 102, and a plurality of cylinder bores 104 in which a plurality of single headed pistons 105 are reciprocally fitted, to suck and compress a refrigerant gas and to discharge the compressed refringent gas. The wobble plate assembly 102 includes a rotary drive element 106 rotatably with articulated with respect to an axial drive shaft 107 and a swash plate 108 non-rotatably supported on the rotary drive element 106, and is driven by a rotatably supported axial drive shaft 107 to which a drive member is fixedly attached to be projected radially and rotated together with the axial drive shaft 107 within the crank chamber 101.

The lug drive member 110 is operatively connected to the rotary drive element 106 of the wobble plate assembly 102 via a hinge mechanism 111, and a sleeve element 112 slidably mounted on the drive shaft 107 is also operatively connected to the rotary drive element 106 of the wobble plate assembly 102. Namely, the rotary drive element 106 is able to be rotated together with the drive shaft 107 and to change an angle of inclination thereof from an erect position corresponding to a small compression capacity position to a fully inclined position corresponding to a large compression capacity position. The hinge mechanism 111 includes an elongated guide hole 113 bored through the drive member 109, and a hinge pin having one end movably fitted in the elongated guide hole 113 of the drive member 109 and the other end fixed to a swing plate member extended from the rotary drive plate 106. The sleeve element 112 is arranged to be axially slid, and is provided with a lateral pin radially projected therefrom to form trunnion pins 115 about which the rotary drive plate 106 is pivotally mounted. The swash plate 108 of the wobble plate assembly 102 is operatively connected to the plurality of pistons 105 via respective piston rods 116 having ball-and-socket joints 117 on both ends, and thus, when the drive shaft 107 is rotated, the rotation of the drive shaft 107 and the rotary drive element 106 is converted into a reciprocation of the respective pistons in the cylinder bores 104. The cylinder block 103 has a communication passageway formed therein extending between the crank chamber 101 and a suction chamber 118, for receiving therein the refrigerant gas before compression. The extent of the communication between the above-mentioned two chambers 101 and 118 is controlled by a capacity control valve (not shown).

With the above-mentioned compressor, when the respective pistons 105 are reciprocated in response to the rotation of the drive shaft 107, the refrigerant gas before compression is pumped from the suction chamber 118 into the cylinder bores 104, to be compressed by the pistons 105 during the suction and compression strokes of the pistons 105, and the compressed gas is discharged from the cylinder bores 104 toward a discharge chamber 119 for the refrigerant gas after compression. During the operation of the compressor, a first and a second force combine to act on the wobble plate assembly 102 from the pistons 105, as a result of the compression and suction of the refrigerant gas by the pistons 105 respectively. The wobble plate assembly 102 is physically supported by the hinge mechanism 111 at a fulcrum position thereof at which the hinge pin 114 is in contact with the guide wall of the elongated guide hole 113 of the drive member 109.

The construction of the above-mentioned hinge mechanism 111 including the projected drive member 109, in engagement with the elongated hole 113 results in an arrangement such that the fulcrum position of the hinge mechanism is moved around the axis of the drive shaft 107. This allows the hinge mechanism to be in constant correspondence with the swash plate 108. As illustrated by FIGS. 9 and 8, when the swash plate 108 is moved in the cylinder bore 104 by the pistons 105 to the top dead center "T", from the bottom dead center "$B_1$", pressure within crank chamber 101 increases. When each of the pistons 105 approaches the top dead center "T", the discharge of the compressed refrigerant gas from the cylinder bore toward the discharge chamber is completed, and as soon as the movement of the piston 105 is reversed at the top dead center "T", the suction of the refrigerant gas before compression is subsequently carried out for a time between "T" and "$B_2$" of FIG. 8. Therefore, when each piston 105 is moved from the bottom dead position "$B_1$" to the top dead center "T", the piston 105 applies the first force to the swash plate 108, which effectively compresses the refrigerant gas. When the piston 105 is moved from the top dead center "T" to the bottom dead center "$B_2$", the piston 105 applies the second force to the swash plate 108, which effectively causes the suction of the refrigerant gas from suction chamber 118 to cylinder bores 104. Accordingly, the sum of the first and second forces, resulting from the reciprocation of each piston, and on the wobble plate assembly 102, is concentrated at a position of the assembly which shifts the direction of the rotation of the rotary drive plate 106. The amount of the shift depends on the number of rotations of the drive shaft 107 and the compression ratio of the refrigerant gas. Therefore, the wobble plate assembly 102, supported by the fulcrum position of the hinge mechanism 111, must be subjected to a bending moment due to the shifting of the position at which the total force of the first and second reaction forces acts on the wobble plate assembly 102 from the fulcrum position of the hinge mechanism 111. This bending moment acting on the wobble plate assembly 102 is absorbed often times as excessive local force on the sleeve element 112 and frequently causes, an abnormal noise generation when the sleeve 112 is slid on the drive shaft 107. Moreover, the physical durability of the sleeve element 112 is thereby reduced.

SUMMARY OF THE INVENTION

Accordingly, it is a primary objective of the present invention to provide a highly durable displacement compressor which generates very little noise due to a reduction of the bending moment generated at wobble plate sleeve mechanism created by the forces of the compression and suction of the compressor pistons.

Further, another objective of the present invention is to provide a high precision variable displacement compressor which easily and securely holds guide pins pivotably connected to support arms.

To achieve the foregoing and other objects and in accordance with the purpose of the present invention, an improved variable compressor is provided. The compressor includes a housing in which a crank chamber is defined. Further, the compressor includes cylinder blocks in which a plurality of cylinder bores are formed, a plurality of pistons which are fitted in the cylinder bores, respectively, a drive shaft which is rotatably supported in the housing, a drive plate mounted on the drive shaft which is integrally rotatable therewith, and a swash plate for compressing a fluid which is tiltably mounted on the drive plate and is connected to the drive plate by means of a hinge mechanism. The undulating movement of the swash plate causes the pistons to perform reciprocal motions. The inclination angle of the swash plate which determines the piston stroke, is controlled based on the pressure in the crank chamber in the housing. The displacement can be varied by changing the inclination angle of the swash plate which is achieved by adjusting the pressure in the crank chamber. The hinge mechanism includes pairs of support arms integrally formed with and protruding from the drive plate, and guide pins which connect the swash plate with the support arms. Each support arm is formed having a unshaped cutaway portion defining a channel for supporting ball portion of the hinge mechanism. The ball portion pivotably secured in the channel portion of the support arm, is attached to guide pin which in turn connect to a bracket protruding from the swash plate. The ball portion transmits pressure & rotational forces created by the pistons and rotational force of the drive plate respectively. The forces cause the ball portion of the hinge mechanism to impinge upon preselected surface areas of the u-shaped support arm. By impinging on these preselected surface areas of the u-shaped support arm, the ball portion will not disengage from the channel portion of the support arm. Moreover the shape of the support arm increases the motility of the ball portion and associate guide pin secured within the support arm. The guide pin are slidably inserted into either the support arm or the swash plate, and are rotatably supported by means of the support arm.

BRIEF DESCRIPTION OF THE DRAWINGS

The feature of the present invention that are believed to be novel are set forth with particularity in the appended claims. The invention, together objects and advantages thereof, may best be understood by reference to the following description of the presently preferred embodiment together with the accompanying drawings, in which:

FIGS. 1 through 4 illustrate the first embodiment of the present invention, wherein:

FIG. 1 is a vertical cross-sectional view of a variable displacement compressor according to the present invention;

FIG. 2 is a partial cross-sectional view showing the elements around a drive plate for use in the compressor as shown in FIG. 1;

FIG. 3 is a cross-sectional view of the upper half of the compressor taken along line A—A as shown in FIG. 1;

FIG. 4 is another construction of the invention according to the first embodiment illustrating the various elements surrounding the drive plate.

DETAILED DESCRIPTION OF THE PREFERRED EMBODIMENTS

First Embodiment

The first preferred embodiment of the present invention will now be described in greater detail, with reference to FIGS. 1 to 4.

Figure 1:
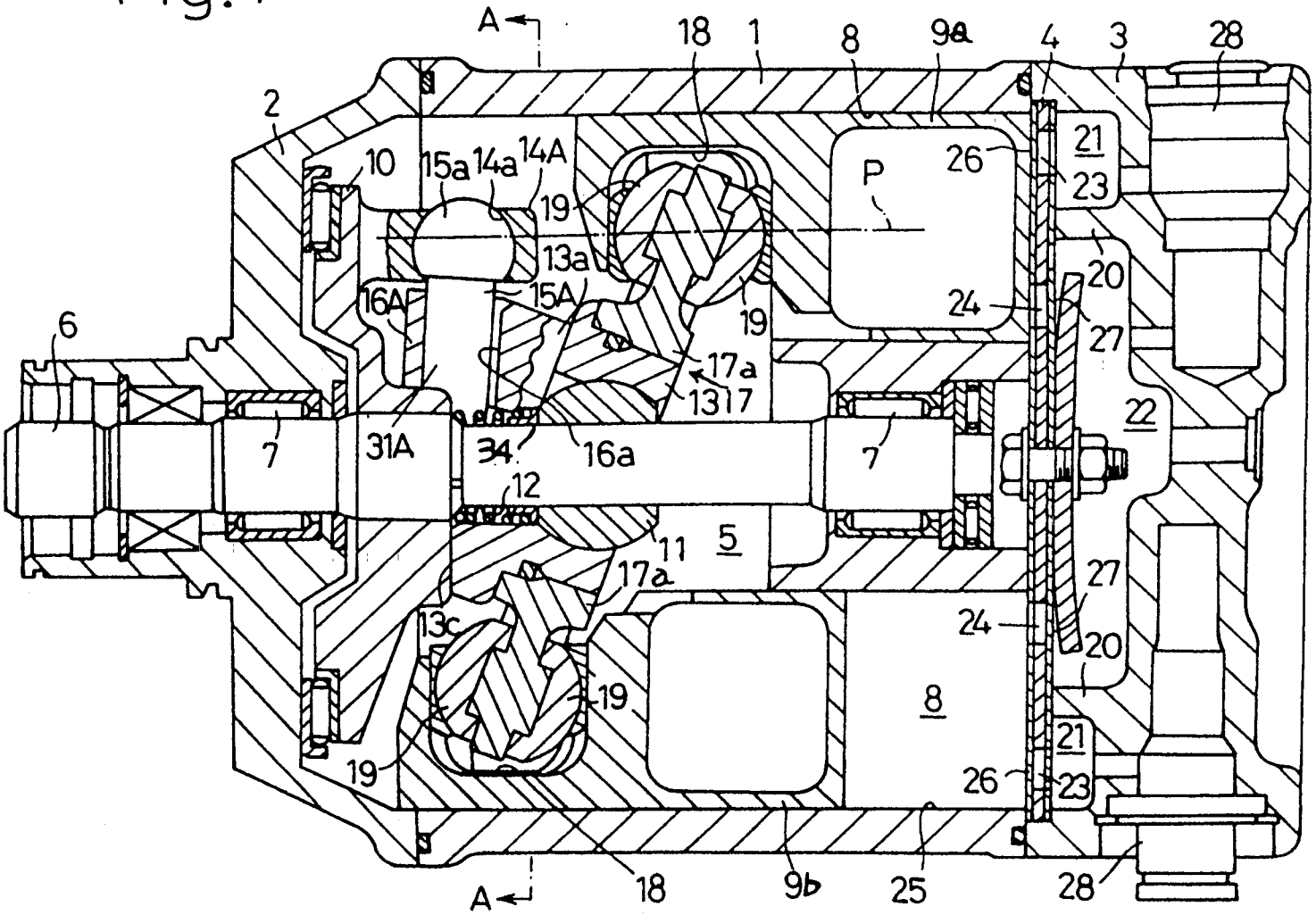

As shown in FIG. 1, a front housing 2 is connected to the front end (left side) of a cylinder block 1, and a rear housing 3 is connected to a rear end (right side) of the cylinder block 1. A valve plate 4 is interposed between the front and rear housings. A drive shaft 6 is accommodated in a crank chamber 5 defined by the cylinder block 1 and the front housing 2. The drive shaft 6 is rotatably supported by a pair of radial bearings 7. The cylinder block 1 has a plurality of cylinder bores 8 arranged around the drive shaft 6. A piston 9 is slidably fitted in each cylinder bore 8. The axis of each piston 9 is adapted to be parallel with that of the drive shaft 6.

A drive plate 10 is supported on the drive shaft 6 in the crank chamber 5, in such a way that it can be rotated integrally with the drive shaft 6. Further, a spherical sleeve 11 is rotatably and slidably fitted around the drive shaft 6. A compression spring 12 is interposed between the drive plate 10 and a drive shaft collar 34 abutting spherical sleeve 11, for urging the spherical sleeve 11 toward the rear housing 3.

Figure 2:
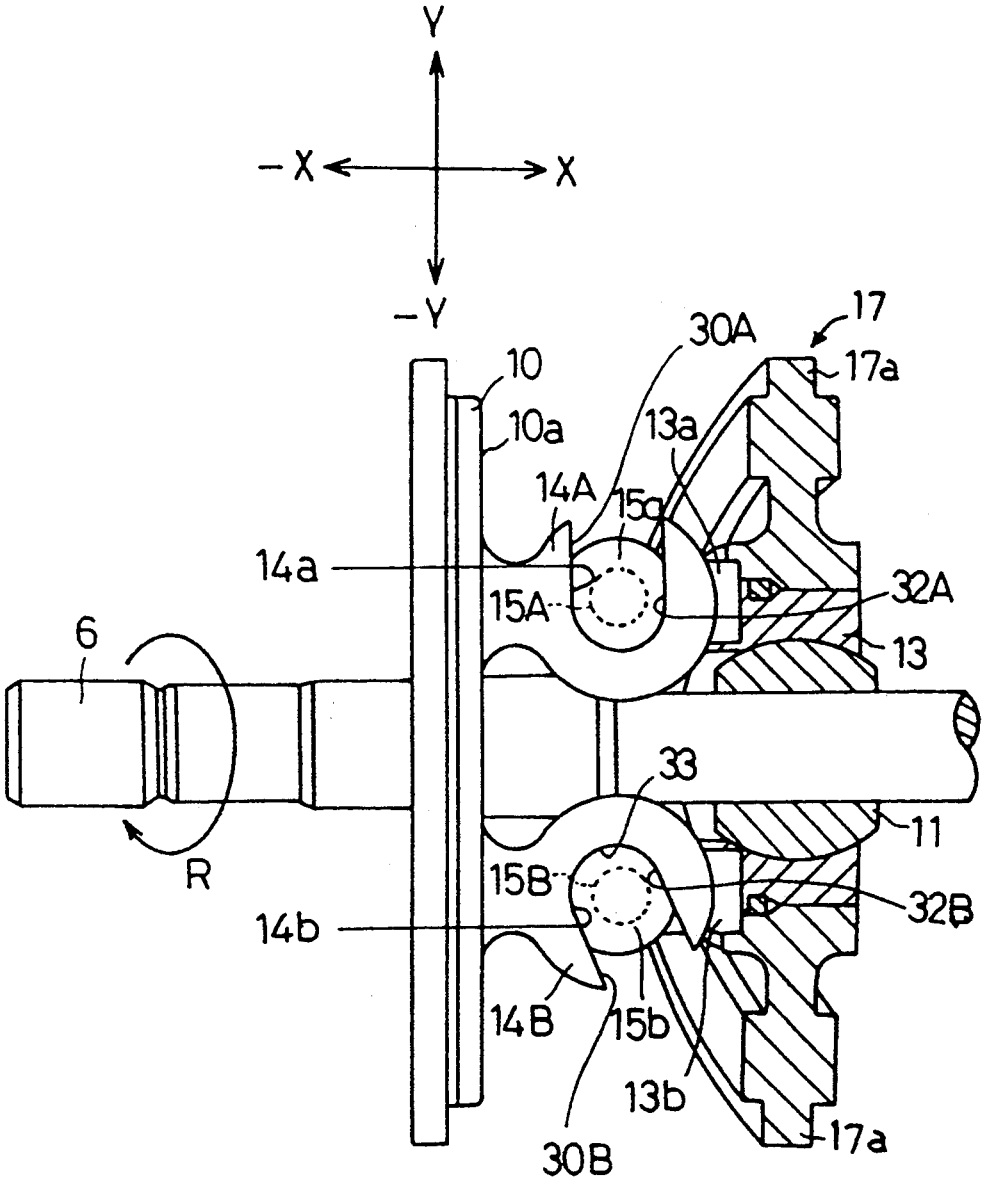

A rotary journal 13 is supported on the spherical sleeve 11 in such a way that it can be rocked forward and backward. The rotary journal 13 has an annular shape, and surrounds the rotary shaft 6. Referring to FIGS. 1 and 2, the rotary journal 13 has a pair of brackets **13*a* and 13*b* protruding on each side of the drive shaft 6, from the upper side face thereof opposite to the front housing 2. The drive plate 10 has a pair of support arms 14A and 14B which protrude in an opposite relation with respect to the corresponding brackets 13*a* and 13*b***.

Figure 3:
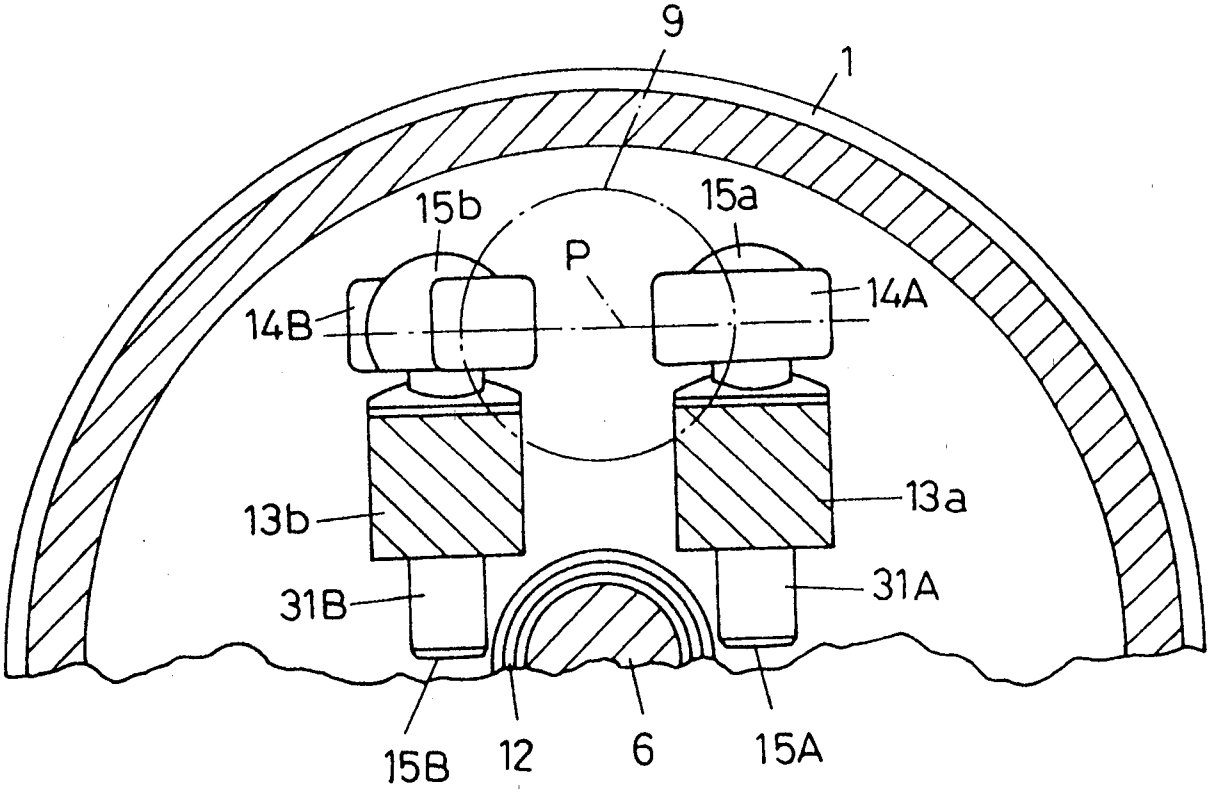
Figure 4:
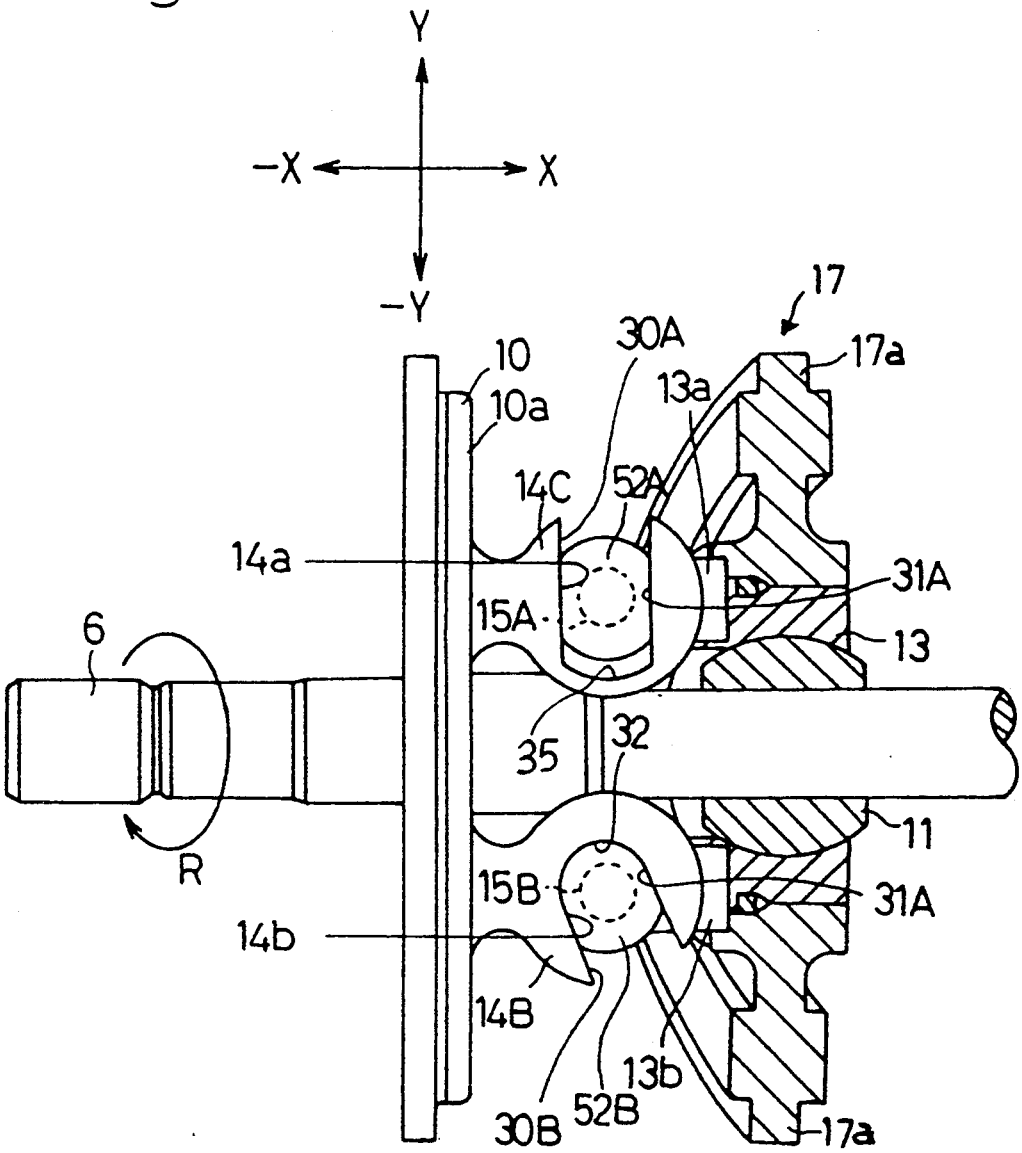

As shown in FIGS. 2 to 4, the compressor has a pair of guide pins 15A and 15B, each of which includes a ball portion **15*a* and a rod portion. A spherical opening 14*a* (14*b*) is defined at the free end portion of each support arm 14A (14B), in which the ball portion 15*a* of the guide pin 15A (15B) is retained. The engagement of the ball portion with the spherical opening allows the guide pin 15A (15B) to be securely and pivotally coupled with the support arm 14A (14B**).

Bosses 16A and 16B include guide holes 16*a* and 16*b* formed at the free end portions of the brackets 13*a* and 13*b*, respectively. The rod portions of the guide pins 15A and 15B are slidably inserted into the guide holes 16*a* and 16*b* of the bosses 16A and 16B, respectively. As the spherical sleeve 11 slides on the drive shaft 6 and the rotary journal 13 rocks, the guide pins 15A and 15B pivot on the ball portion 15*a* while they slide along the guide holes 16*a* and 16*b*, respectively. Accordingly, the rotary journal 13 is coupled with the drive plate 10 by the guide pins 15A and 15B, in such a way that the rotary journal 13 may be rotated synchronously with the drive plate 10, regardless of the position of the spherical sleeve 11 or the inclination angle of the rotary journal 13.

As shown in FIG. 2, surfaces are formed on the support arms 14A and 14B, on which the pressure acting along the axis direction (i.e., along X, −X direction) and the pressure acting along the direction (i.e., along Y, −Y direction perpendicular to the axis direction are applied. More specifically, cutaway portions 30A and 30B are formed in the support arms 14A and 14B, respectively. These cutaway portions open in substantially opposite directions with respect to each other. The guide pins 15A and 15B are rotatably attached and detached to and from the support arms through the cutaway portions 30A and 30B, respectively. The cutaway portion 30A in the support arm 14A is formed to face toward the Y direction which is perpendicular to the X, −X direction, and has a larger diameter than that of the ball portion 15*a* of the guide pin 15A for easy fitting. A receiving surface 32A is formed in the support arm 14A which receives the pressure acts along the X, −X direction.

The cutaway portion 30B in the support arm 14B is formed at a location along the clockwise direction from the X direction to the −Y direction. The cutaway portion 30B has a larger diameter than that of the ball portion 15*b* of the guide pin 15B for easy fitting. The support arm 14B has a receiving surface 32B which is faced toward the −X direction and receives the compression reaction force, and a receiving surface 33 which is faced toward the −Y direction and transmits the rotational force. The cutaway portions 30A and 30B are formed to open in opposing directions with respect to each other.

When the compression spring 12 has been compressed to the maximum level, as shown in FIG. 1, the contact surface 13*c*, i.e. the lower side face opposite to the front housing 2 of the rotary journal 13, is abutted against the drive plate 10, whereby the rotary journal 13 is prevented from tilting any further.

As illustrated by FIGS. 1 and 2, a swash plate 17 is formed by a peripheral portion 17*a* and the rotary journal 13, the portion 17*a* being mounted on the circumference of the rotary journal 13. The hinge mechanism includes the swash plate 17, guide pins 15A and 15B, and a pair of support arms 14A and 14B. A recess 18 is formed at the tail end portion of the piston 9 fitted in each cylinder bore 8. The peripheral portion of the swash plate 17*a* is retained via a pair of shoes 19 within the recess 18. Accordingly, the rotational motion of the drive shaft 6 is transmitted to the swash plate 17 through the drive plate 10, guide pins 15A and 15B and rotary journal 13. The rotational motion of the tilted swash plate 17 eventually generates an undulating movement, to cause the reciprocal motion of each piston 9.

The inside of the rear housing 3 is divided into an inlet chamber 21 and a discharge chamber 22 by a cylindrical partition 20. The valve plate 4 has a plurality of inlet ports 23 and a plurality of discharge ports 24 formed for the respective cylinder bores 8. Compression chambers 25 are defined between the valve plate 4 and the respective pistons 9. The volume of the chamber 25 varies according to the movement of piston 9. Each compression chamber 25 communicates with the inlet chamber 21 or the discharge chamber 22, through the corresponding inlet ports 23 or outlet ports 24, respectively. Each inlet port 23 and each outlet port 24 is blocked by an inlet valve 26 and a discharge valve 27, respectively. These valves open or close the inlet ports 23 and discharge ports 24 depending on the difference between the pressures on the both sides of each valve to be caused by the reciprocal motion of the pistons 9.

Incidentally, a volume controlling valve mechanism 28 of a known structure for controlling the pressure in the crank chamber 5 is provided in the rear housing 3. The function of the compressor according to the present embodiment will now be described below.

A refrigerant gas which is sucked from the inlet chamber 21 into the respective compression chambers 25, by the reciprocal motion of the pistons 9, is compressed therein, and is discharged to the discharge chamber 22. In this process, the pressure exerted on the head end face of each piston 9, in the cylinder bore 8, fluctuates between the suction pressure and the discharge pressure in accordance with the sucking and discharging (compression) motion of each piston 9. A force corresponding to the difference between the pressure exerted on the head end face of each piston 9 and the pressure, exerted on the tail end face of the piston 9 in the crank chamber 5, is transmitted to the swash plate 17 via the respective shoes 19. The resultant force exerted on the swash plate 17 by each piston 9 produces a moment which causes the swash plate 17 to rotate clockwise or counterclockwise on the spherical sleeve 11. This moment causes a change in the inclination angle of the swash plate 17 and thus regulates the piston stroke.

With the change in the inclination angle of the swash plate 17 based on the difference between the internal pressure in the crank chamber 5 and the suction pressure, the ball portions 15*a* and 15*b* slide and synchronously rotate with respect to spherical recesses 14*a* and 14*b* formed in the support arms 14A and 14B, respectively. The guide pins 15A and 15B slide along the guide holes 16*a* and 16*b* and a pivot with respect to the drive plate 10. The rotary journal 13 tilts and slides on the drive shaft 6 simultaneously with the movement of the spherical sleeve 11 on drive shaft 6 that the distance between the valve plate 4 and the point (the top of the swash plate in FIG. 1) on the swash plate 17 closest to the valve plate 4 remain substantially constant. As a result, the top clearance of each piston 9 is maintained substantially constant, regardless of the inclination angle of the swash plate 17.

FIG. 2 shows the condition where the piston 9 is at the top dead center which is located at the most upper position of the cylinder bore 8. Since the drive shaft 6 always rotates along the direction indicated by an arrow R, the support arm 14A always receives the pressure from the suction side, i.e., the compression reaction force from the swash plate 17 along the −X direction. The suction force acting along the X direction exerts a reaction force on the arm 14A. Since the compression and suction reaction forces act along the X and −X directions rather than the −y and y, the force they exert is directed to the receiving surface 32A of the support arm 14A.

At a time when piston 9a creates suction pressure in cylinder bore 8, the movement of the swash plate 17 causes guide pin 15A to exert a force on the receiving surface 32A. Simultaneously, support arm 14B has a corresponding force exerted in the −x direction against receiving service 32B due to the pivoting of guide pin 15B. Also at this time, support arm 14B has an applied force directed in the y direction against receiving service 33, due to the rotation of support arm 14B by drive shaft 6 in the R direction. Therefore, the cutaway portion 30B is formed at a location along the clockwise direction from the X direction to the −Y direction, allowing the guide pin 15B to be easily inserted therein. Accordingly, the guide pin 15B is not easily detached from the cutaway portion 30B while the compressor is operating.

As clearly described above, since the guide pins 15A and 15B can be easily inserted in the cutaway portions 30A and 30B, respectively, the accuracy of the spherical recesses **14*a* and 14*b* for fitting therewith is substantially high, with very little play existing between the spherical recess 14*a*,14*b* and guide pins 15A,15B**. Therefore, the displacement of the compressor can be accurately controlled.

Since the cutaway portions 30A and 30B respectively face opposing directions, it is not expected that any associated guide pins would become disengaged from the corresponding support arms.

As the support arms 14A and 14B in this embodiment include the cutaway portions 30A and 30B, the guide pins 15A and 15B are pivotally supported by means of the support arms 14A and 14B, respectively. As a result of the reciprocation of piston 9, the line of force resultant there from remains constant with respect to line P. This in turn, reduces the shear force applied to the support arm 14A by the guide pin 15A during the rotation of the support arm 14A. As a result the guide pins 15A and 15B pivot within support arms 14A and 14B with a smooth and continuous motion. Moreover, the smooth operational movement of guide pins 15A and 15B accurately result in a constant regulation of the pressure introduced to and from chamber 8 through inlet port 23 and discharge port 24.

As shown in FIG. 4, a support arm 14C is formed using a deep spherical milling process along the −Y direction at the suction side. The spherical recess deeply milled provides a gap between the guide pin 15A and the support arm 14C. This gap absorbs the Y, −Y directional fitting tolerance of the guide pin 15A, which is created at the fitting of the pin 15A to support arm 14C. Due to the reciprocation of pistons 9, the support pins 15A and 15B, of the invention according to this embodiment, receive applied forces only in the x and −x directions. This alleviates the need to design a support pin for receiving applied forces in either the y or −y direction. That is, according to the present invention, no applied force is generated from the ball 52A onto the surface 35 of support arm 15A. Therefore the support arm 14C, having spherical recesses deeply milled in the −y direction remains uneffected by the compression suction forces acting in a direction perpendicular to support arm 14C.

Second Embodiment

The second embodiment according to the present invention will now be described in greater detail, with reference to FIGS. 5 to 7.

In this embodiment, only a hinge mechanism differs from that in the first embodiment. Therefore, the hinge mechanism in the second embodiment is described hereinafter. However, the elements in the second embodiment corresponding to those in the first embodiment are given the similar numerical alphabetical reference numbers.

Figure 5:
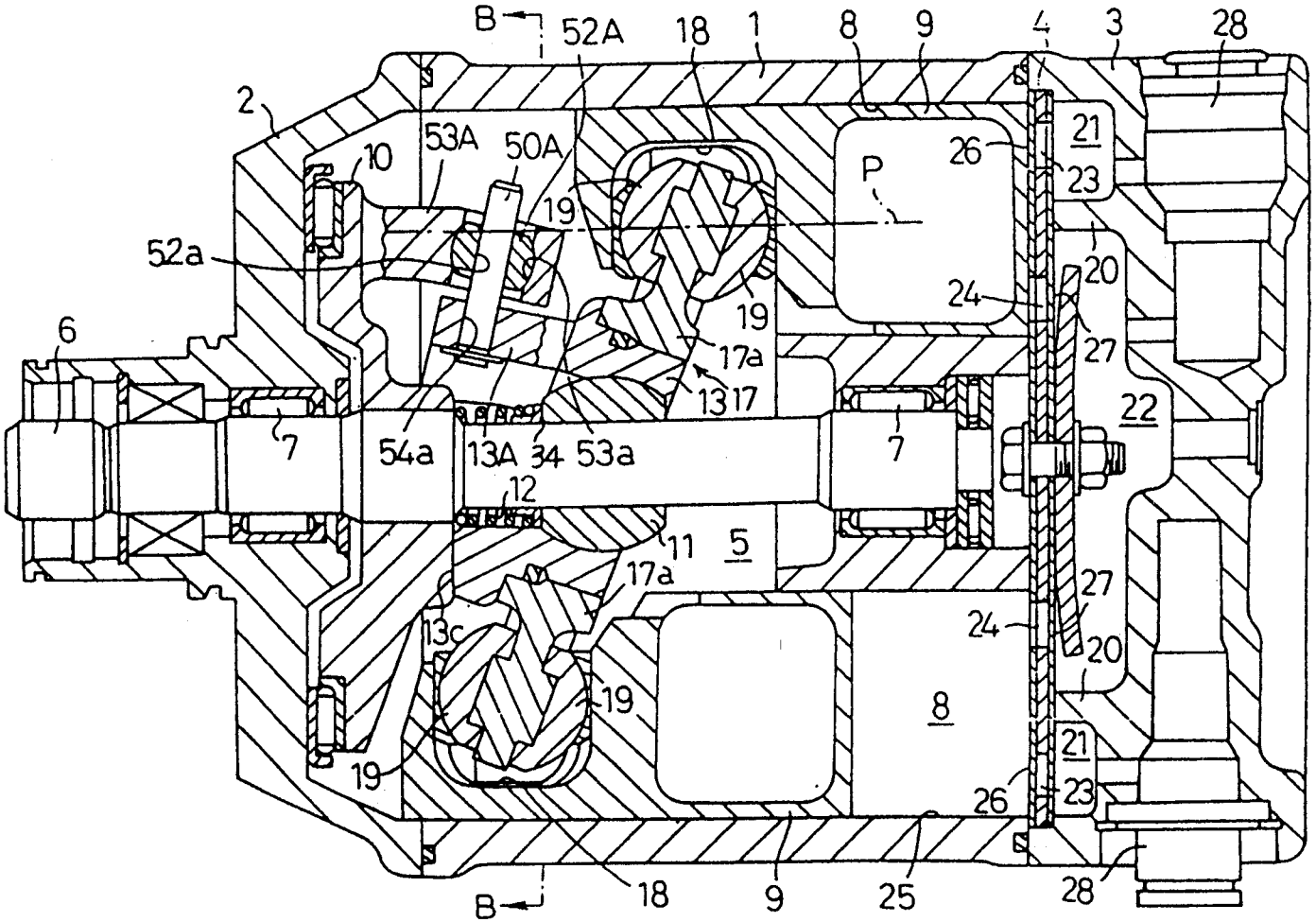
FIG. 5 is a cross-sectional view of a variable displacement compressor according to the second embodiment of the present invention.
Figure 6:
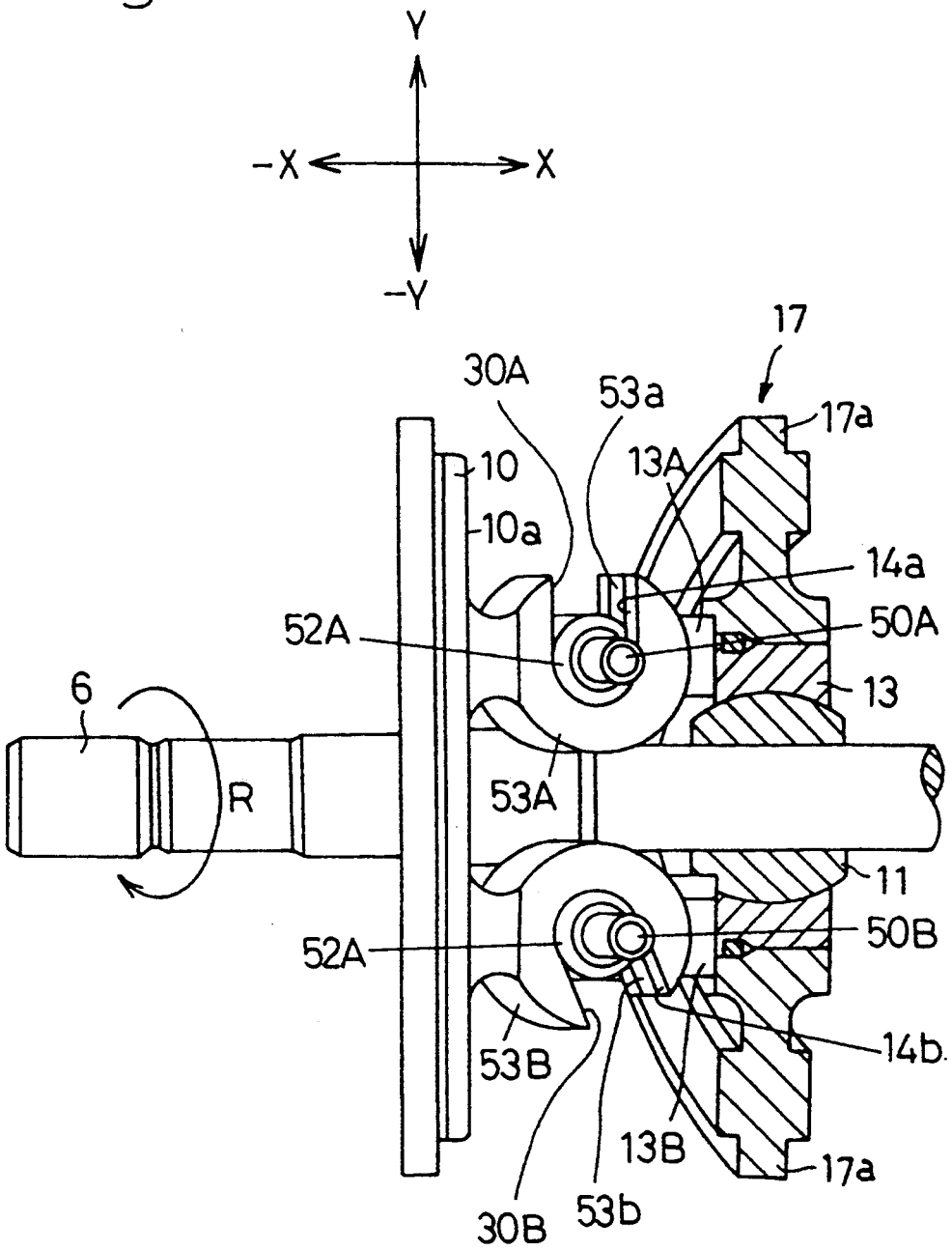
FIG. 6 is a partial cross-sectional view showing the elements around a drive plate for use in the compressor as shown in FIG. 5.
Figure 7:
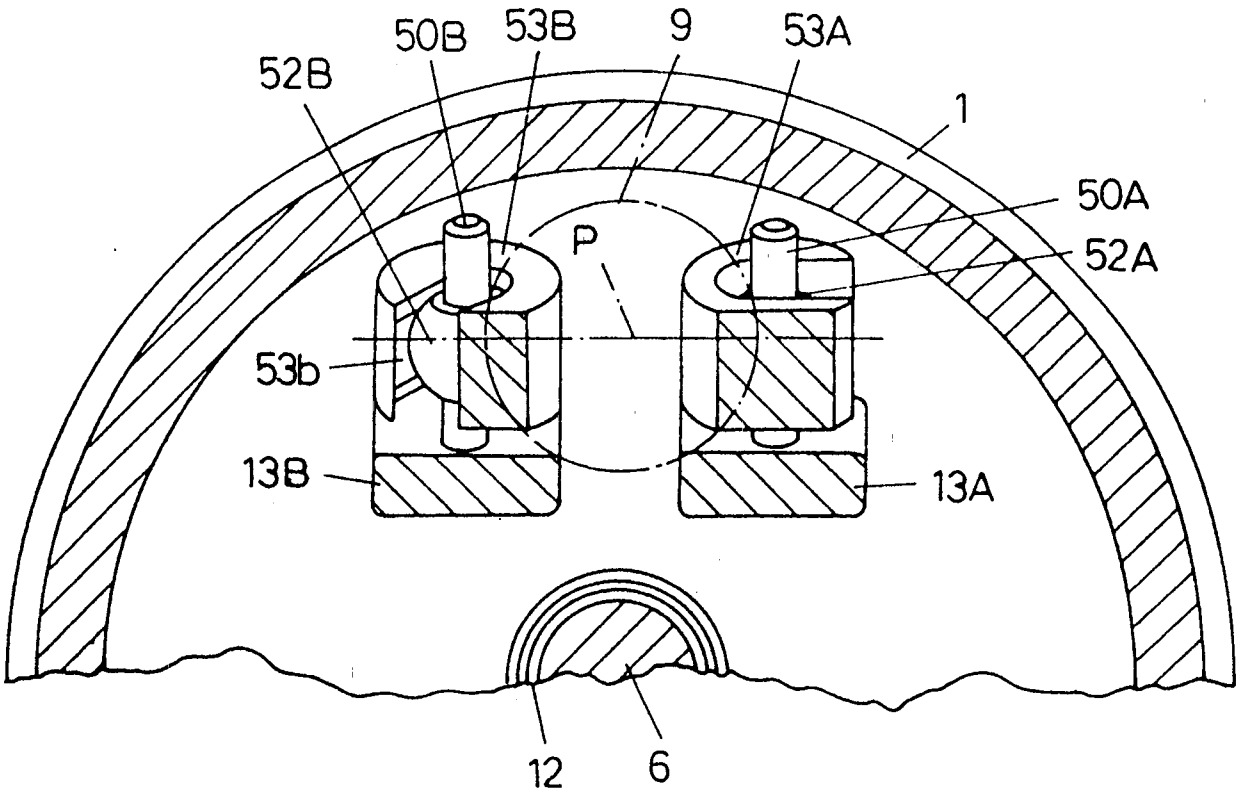
FIG. 7 is a cross-sectional view of the upper half taken along line B—B as shown in FIG. 5.
Figure 8:
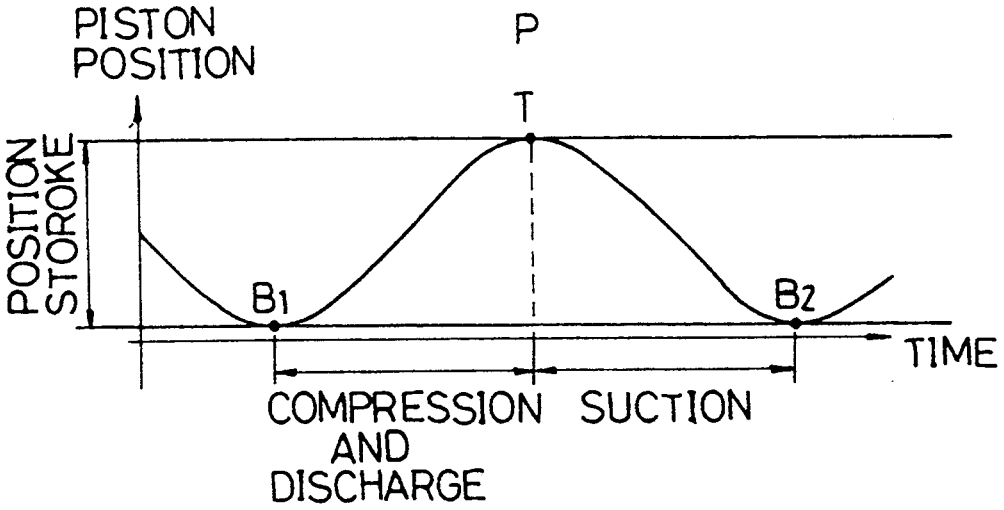
Fig. 8 PRIOR ART
FIG. 8 is a graph showing the position of the piston with respect to time in a prior art compressor.
Figure 9:
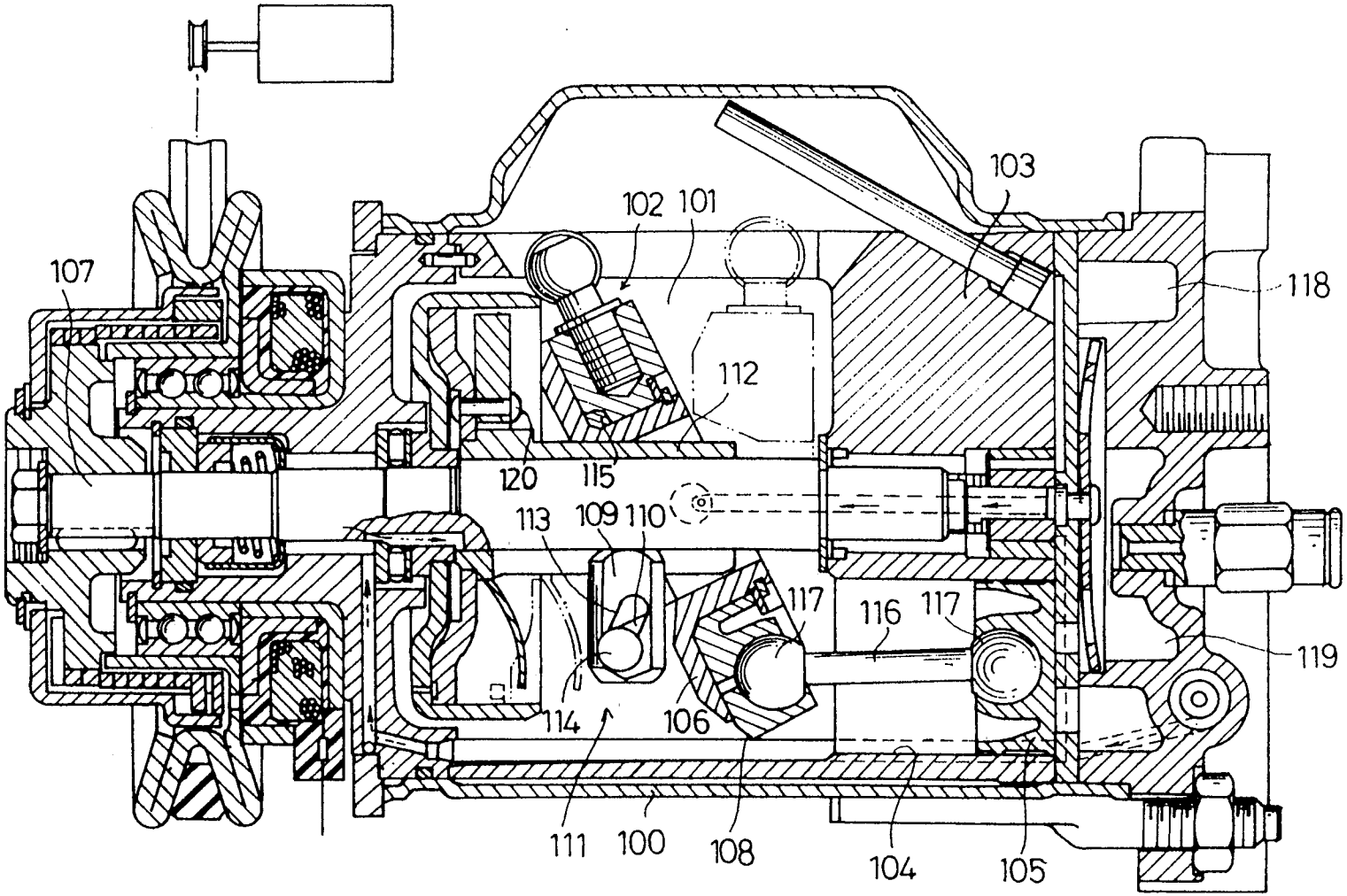
Fig. 9 (PRIOR ART)
FIG. 9 is a vertical cross-sectional view of prior art variable displacement compressor.

As shown in FIGS. 5 and 6, support arms 53A and 53B are integrally formed at the inner surface of drive plate 10 which connects with the drive shaft 6. Channels **53*a* and 53*b* are bored in the arms 53A and 53B, respectively. Ball portions 52A are rotatably and slidably fitted in the channels 53*a* and 53*b*, respectively. A guide hole 52*a* of FIG. 5 is bored at the central portion of the ball portion 52A. A rod shaped guide pin 50A is reciprocally and slidably inserted in the guide hole 52*a*. The proximal end of the pin 50A is fitted in a hole 54*a* which is formed in the rotary journal 13. The journal 13 is tilted forward or backward, and has the ball portion 52A** as the center of tilting motion.

Similar to the compressor in the first embodiment, the inclination angle of the swash plate 17 varies, based on the difference between the internal pressure in the crank chamber 5 and the suction pressure. Accompanying a change in the inclination angle, the guide pin 50A, integrally rotated by drive plate 10, slides along the guide hole **52*a* bored in the ball portion 52A within the support arm 53A. The ball portions 52A at the same time slide in the channels 53*a* and 53*b*, the rotary journal 13 slides along the drive shaft 6, and the top position of the swash plate 17 remains substantially unchanged. As a result, the top clearance of each piston 9 remains essentially constant, regardless of the inclination angle of the swash plate 17**.

As shown in FIG. 6, since the drive shaft 6 always rotates along the direction indicated by an arrow R, the support arm 53A receives only the X, −X directional compression and suction reaction forces. The support arm 53B receives only a −X directional compression reaction force from the swash plate 17 and a −Y directional force which transmits the rotational motion of the drive plate 10 to the guide pin 15B. Therefore, the cutaway portion 30A can be formed in the support arm 53A, which opens toward the Y direction. The cutaway portion 30B can be formed at the location of the support arm 53B along the clockwise direction from the X direction to the −Y direction.

Though the support arms 53A and 53B in this embodiment include the cutaway portions 30A and 30B, the guide pins 50A and 50B are pivotally supported by means of the support arms 53A and 53B, respectively. As a result of the reciprocation of piston 9, the line of force resultant there from remains constant with respect to line P. This in turn, reduces the shear force applied to the support arm 53A by the guide pin 50A during the rotation of the support arm 53A. As a result the guide pins 50A and 50B pivot within support arms 53A and 53B with a smooth and continuous motion. Moreover, the smooth operational movement of guide pins 50A and 50B accurately result in a constant regulation of the pressure introduced to and from chamber 8 through inlet port 23 and discharge port 24.

Since the spherical recess of the suction side of the support arm is milled deeply in the Y direction, a gap is developed between the pin 50A and arm 53A. Thus, the manufacturing tolerance of spherical recess in support arm 15A does not remain a crucial consideration in the manufacture of the variable displacement compressor according to this embodiment of the present invention. Further, since the directions of the cutaway portions 30A and 30B disposed at the discharge side of the support arm do not coincide each other, each of the guide pins 50A and 50B are prevented from being disengaged from their respective support arms.

Although only two embodiments of the present invention have been described herein, it should be apparent to those skilled in the art that the present invention may be embodied in many other specific forms Without departing from the spirit or scope of the invention. Particularly, it should be understood that following modes are to be applied.

The present invention can be embodied in a compressor having a connecting mechanism in which the swash plate and pistons are connected by means of piston rods and a wobble plate, i.e., in a wobble type compressor, instead of the connecting mechanism in which the swash plate and pistons are connected by means of the shoe 19 as embodied in the first and second embodiments.

Therefore, the present examples and embodiments are to be considered as illustrative and not restrictive and the invention is not to be limited to the details giving herein, but may be modified within the scope of the appended claims.

What is claim is:

1. A variable displacement compressor comprising:

a housing having a crank chamber therein;

a cylinder block having a plurality of cylinder bores;

a plurality of pistons slidably fitted within each of said cylinder bores;

a drive shaft rotatably mounted in said housing;

a drive plate mounted on said drive shaft for integral rotation therewith, said drive plate having at least a pair of support arms formed integrally with said drive plate and protruding therefrom, each of said support arms having a u-shaped cutaway portion defining a channel having an open surface of a predetermined opening width, said u-shaped surface being formed within said support arm defining a socket area;

a swash plate tiltably mounted on said drive shaft, said swash plate having a bracket projecting toward said drive plate and operating to drive said pistons in a reciprocal motion for generating fluid compression and suction pressures within said cylinder bore, said swash plate further having an angle of inclination controlled by varying the pressure within said crank chamber;

hinge means for connecting said swash plate with said drive plate, said hinge means including a ball pivotably disposed within said socket area, a guide pin connecting said ball to said bracket, said pin being slidable with respect to at least one of said ball and said bracket;

said ball being held in said channel such that the rotational force of said drive plate and the reaction force of said compressed fluid and suction pressure applied to said pistons are transmitted by said ball of said hinge means to preselected inner portions within said channel, said preselected portions being chosen to prevent the disengagement of said ball from said socket area and to increase the motility of said guide pin with respect to said bracket and said ball.

2. A compressor according to claim 1, wherein each support arm has one u-shaped cutaway portion formed in the substantially opposed direction from the u-shaped cutaway portion of the associate support arm.

3. A compressor according to claim 1 further including a sleeve slidably mounted on said drive shaft, said sleeve tiltably supporting said swash plate on said drive shaft.

4. A compressor according to claim 1, wherein the predetermined open surface width of said cutaway portion is larger than the diameter of said ball.

5. A variable displacement compressor comprising:

a housing having a crank chamber therein;

a cylinder block having a plurality of cylinder bores;

a plurality of pistons slidably fitted within each of said cylinder bores;

a drive shaft rotatably mounted in said housing;

a drive plate mounted on said drive shaft for integral rotation therewith, said drive plate having at least a pair of support arms formed integrally with said drive plate and protruding therefrom, each of said support arms having a u-shaped cutaway portion defining a channel having an open surface of a predetermined opening width, said u-shaped surface being formed within said support arm defining a socket area;

a swash plate tiltably mounted on said drive shaft, said swash plate having a bracket projecting toward said drive plate and operating to drive said pistons in a reciprocal motion for generating fluid compression and suction pressures within said cylinder bore, said swash plate further having an angle of inclination controlled by varying the pressure within said crank chamber;

hinge means for connecting said swash plate with said drive plate, said hinge means including a ball pivotably disposed within said socket area, a guide pin connecting said ball to said bracket, said bracket being formed with a hole for slidably receiving said guide pin;

said ball being held in said channel such that the rotational force of said drive plate and the reaction force of said compressed fluid and suction pressure applied to said pistons are transmitted by said ball of said hinge means to preselected inner portions within said channel, said preselected portions being chosen to prevent the disengagement of said ball from said socket area and to increase the motility of said guide pin with respect to said bracket and said ball.

6. A compressor according to claim 5, wherein each support arm has one u-shaped cutaway portion formed in the substantially opposed direction from the u-shaped cutaway portion of the associate support arm.

7. A compressor according to claim 5 further including a sleeve slidably mounted on said drive shaft, said sleeve tiltably supporting said swash plate on said drive shaft.

8. A compressor according to claim 5, wherein the predetermined open surface width of said cutaway portion is larger than the diameter of said ball.

9. A variable displacement compressor comprising:

a housing having a crank chamber therein;

a cylinder block having a plurality of cylinder bores;

a plurality of pistons slidably fitted within each of said cylinder bores;

a drive shaft rotatably mounted in said housing;

a drive plate mounted on said drive shaft for integral rotation therewith, said drive plate having at least a pair of support arms formed integrally with said drive plate and protruding therefrom, each of said support arms having a u-shaped cutaway portion defining a channel having an open surface of a predetermined opening width, said u-shaped surface being formed within said support arm defining a socket area;

a swash plate tiltably mounted on said drive shaft, said swash plate having a bracket projecting toward said drive plate and operating to drive said pistons in a reciprocal motion for generating fluid compression and suction pressures within said cylinder bore, said swash plate further having an angle of inclination controlled by varying the pressure within said crank chamber;

hinge means for connecting said swash plate with said drive plate, said hinge means including a ball pivotably disposed within said socket area, a guide pin connecting said ball to said bracket, said pin comprising a first and second end, said first end being fixedly connected to said bracket and said second end being slidably connected to said ball;

said ball being held in said channel such that the rotational force of said drive plate and the reaction force of said compressed fluid and suction pressure applied to said pistons are transmitted by said ball of said hinge means to preselected inner portions within said channel, said preselected portions being chosen to prevent the disengagement of said ball from said socket area and to increase the motility of said guide pin with respect to said bracket and said ball.

10. A compressor according to claim 9, wherein each support arm has one u-shaped cutaway portion formed in the substantially opposed direction from the u-shaped cutaway portion of the associate support arm.

11. A compressor according to claim 9 further including a sleeve slidably mounted on said drive shaft, said sleeve tiltably supporting said swash plate on said drive shaft.

12. A compressor according to claim 9, wherein the predetermined open surface width of said cutaway portion is larger than the diameter of said ball.

* * * * *